US008246272B1

(12) United States Patent
Heitz

(10) Patent No.: US 8,246,272 B1
(45) Date of Patent: Aug. 21, 2012

(54) ACTUATED SPILL BARRIER

(75) Inventor: Paul-Victor Heitz, Louisville, KY (US)

(73) Assignee: Denios, Inc., Louisville, KY (US)

( * ) Notice: Subject to any disclaimer, the term of this patent is extended or adjusted under 35 U.S.C. 154(b) by 409 days.

(21) Appl. No.: 12/689,416

(22) Filed: Jan. 19, 2010

(51) Int. Cl.
*E02B 7/40* (2006.01)

(52) U.S. Cl. ..... 405/92; 405/52; 405/99; 405/105

(58) Field of Classification Search ..... 405/52, 405/80, 87, 92, 94, 99, 105, 106; 49/10, 49/131; 137/527; 251/303
See application file for complete search history.

(56) References Cited

U.S. PATENT DOCUMENTS

| | | | | |
|---|---|---|---|---|
| 3,643,615 | A * | 2/1972 | Cohen | 114/335 |
| 4,031,676 | A | 6/1977 | Dally | |
| 4,059,362 | A | 11/1977 | Smith | |
| 4,632,602 | A | 12/1986 | Hovnanian | |
| 4,765,775 | A | 8/1988 | Kroger | |
| 5,077,945 | A | 1/1992 | Koeniger | |
| 5,114,270 | A | 5/1992 | Riddle | |
| 5,114,274 | A | 5/1992 | Heiler, Jr. | |
| 5,460,462 | A | 10/1995 | Regan | |
| 5,501,045 | A | 3/1996 | Wexler | |
| 5,689,920 | A | 11/1997 | Hallsten | |
| 6,216,399 | B1 | 4/2001 | Belarbi | |
| 6,425,707 | B1 | 7/2002 | Baxter | |
| 6,514,011 | B2 | 2/2003 | Nomura et al. | |
| 6,623,209 | B1 * | 9/2003 | Waters, Jr. | 405/94 |
| 6,695,534 | B2 | 2/2004 | Cain et al. | |
| 6,732,479 | B2 | 5/2004 | Nomura et al. | |
| 7,497,644 | B1 | 3/2009 | Cohen | |
| 2006/0250258 | A1 | 11/2006 | Anhamm | |

FOREIGN PATENT DOCUMENTS

| | | | |
|---|---|---|---|
| EP | 0586356 | A1 | 3/1994 |
| GB | 2236344 | A | 4/1991 |
| JP | 2005076437 | A | 3/2005 |

OTHER PUBLICATIONS

Denios Inc. ; The Hazmat Pro Catalog; Sep. 2009; pp. 62-63; Denios, Inc., Louisville, KY, United States.

* cited by examiner

*Primary Examiner* — John Kreck
*Assistant Examiner* — Sean Andrish
(74) *Attorney, Agent, or Firm* — James E. Cole; Middleton Reutlinger

(57) ABSTRACT

An actuated spill barrier, comprises a chassis having a first pier and a second pier, a sump disposed within the chassis, the sump structure having a first angled wall at a first side and a second angled wall at an opposite second side, a door pivotally connected to the first pier and the second pier, the door having an angled first end surface and an angled second end surface, the first angled wall and the angled first end surface being supplementary angles and the second angled wall and the angled second end surface being supplementary angles inhibiting binding of the door, wherein thermal expansion of the door causes the first end surface to climb upwardly along said first angled wall and said second end surface to climb upwardly along said second angled wall inhibiting binding of said door in said sump, the door being biased to pivot from a first actuated position to a second position sealing against the first pier and the second pier.

22 Claims, 11 Drawing Sheets

ACTUATED SPILL BARRIER

CROSS-REFERENCE TO RELATED DOCUMENTS

None

TECHNICAL FIELD

The present invention pertains to an actuated spill barrier. More specifically, the present invention pertains to actuated spill barrier which may be float activated or heat activated through thermal expansion to cause an initial rise of a barrier and which maintains operability during high heat conditions.

BACKGROUND

It is known to utilize a barricade or barrier for a particular area of a plant or facility wherein fluid is stored in order to inhibit leaking fluid from entering adjacent rooms or areas of the plant or facility. Additionally, it is desirable to inhibit mixture of the fluid with incoming water or other such material, for example, when water for fire suppression is pumped into the liquid storage area during a fire.

In order to meet requirements for approval of certain Codes and Ordinances, it is desirable to activate the barrier in at least two manners. First, it is desirable to actuate the barrier when fluid enters the area where the barrier is stored. Additionally, it is desirable to actuate the barrier based on heat in the area of the barrier due to a fire.

It is also desirable that when subjected to the fluid leakage or fire condition, the barrier operate properly even at extreme temperature conditions.

It is further desirable to ensure that the barrier not seize or bind with adjacent components due to thermal expansion when subjected to the high heat conditions, such as those which occur during a chemical or building fire.

Accordingly, it would be desirable to overcome these and other deficiencies in prior art barriers in order to provide a spill barrier which meets certain Code requirements and operates during extreme conditions.

SUMMARY

An actuated spill barrier, comprises a chassis having a first pier and a second pier, a sump disposed within the chassis, the sump structure having a first angled wall at a first side and a second angled wall at an opposite second side, a door pivotally connected to the first pier and the second pier, the door having an angled first end surface and an angled second end surface, the first angled wall and the angled first end surface being supplementary angles and the second angled wall and the angled second end surface being supplementary angles inhibiting binding of the door, wherein thermal expansion of the door causes the first end surface to climb upwardly along said first angled wall and said second end surface to climb upwardly along said second angled wall inhibiting binding of said door in said sump, the door being biased to pivot from a first actuated position to a second position sealing against the first pier and the second pier. The actuated spill barrier further comprising at least one seal structure on each of the first and second piers. The actuated spill barrier wherein the door is substantially flush with a surrounding substrate when disposed in a normal horizontal position within the sump. The actuated spill barrier wherein the second position being substantially vertical. The actuated spill battier wherein the second position is about 110 degrees from the first horizontal position. The actuated spill barrier wherein heat causes thermal expansion of the door. The actuated spill barrier wherein the door rises from the sump during the thermal expansion. The actuated spill barrier further comprising at least one spring to bias the door after the door rises during the thermal expansion. The actuated spill barrier wherein the spring is a first stage spring and a second stage spring. The actuated spill barrier wherein the door is at least partially buoyant. The actuated spill barrier wherein the door lifts when the sump fills with a fluid to a first actuated position. The actuated spill barrier wherein the door is biased from an actuated position by at least one biasing element after a primary actuation after said door lifts due to buoyant forces. The actuated spill barrier wherein the at least one biasing element is at least one spring. The actuated spill barrier wherein the at least one spring is a first spring and a second spring in each of the first and second piers.

An actuated spill barrier, comprises a chassis having a sump therein and a first pier and a second pier, a door pivotally connected to at least one of the chassis, the first pier or the second pier, the door having a first end and a second end, the first end and the second end being tapered at an angle supplementary to adjacent of the sump so that thermal expansion of the door causes the door to raise from the sump without binding, the door being movable from a first position horizontally disposed within the sump to a second position sealingly engaging the first pier and the second pier, a biasing assembly disposed within each of the first pier and the second pier, the biasing assembly operably connected to the door, the biasing assembly lifting the door to sealing engagement with the first and second piers after the door is at least partially raised from the sump. The actuated spill barrier wherein the door is buoyant so to raise when fluid levels exceed a preselected amount in the sump. The actuated spill barrier wherein the biasing assembly includes a lever arm, the lever arm being operably connected to the door. The actuated spill barrier further comprising at least one spring. The actuated spill barrier further comprising a first spring and a second spring in each of the first pier and the second pier, the one of the first spring and the second spring lifting the door a first distance and the other of the first spring and the second spring lifting the door a second distance. The actuated spill barrier wherein the door rotates from a substantially horizontal position in the sump to a position slightly beyond vertical.

An actuated spill barrier, comprises a chassis including a sump and opposed first and second piers, a door pivotally connected to the chassis and movable from a first substantially horizontal position to a second position substantially sealingly engaging the first and second piers, a biasing assembly disposed in the chassis to cause the pivotal movement, the door having a first end and a second end, each of the first and second ends being tapered and supplementary to corresponding sides of the sump, the door being movable to a first actuated position by a primary actuation and the door being movable to the second position by a secondary actuation of said biasing assembly.

A method of actuating a spill barrier, comprises positioning a door in a first position within a sump, thermally expanding the door, forcing the door out of the sump a first distance by supplementary angles of door end walls and adjacent sump surfaces, and actuating the door to a second sealed position with a biasing assembly.

BRIEF DESCRIPTION OF THE ILLUSTRATIONS

In order that the invention may be better understood, embodiments of the actuated spill barrier in accordance with the present invention will now be described by way of examples. These embodiments are not to limit the scope of the present invention as other embodiments of the actuated spill barrier will become apparent to one having ordinary skill in the art upon reading the instant description. Examples of the present invention are shown in figures wherein.

DETAILED DESCRIPTION

Figure 1:
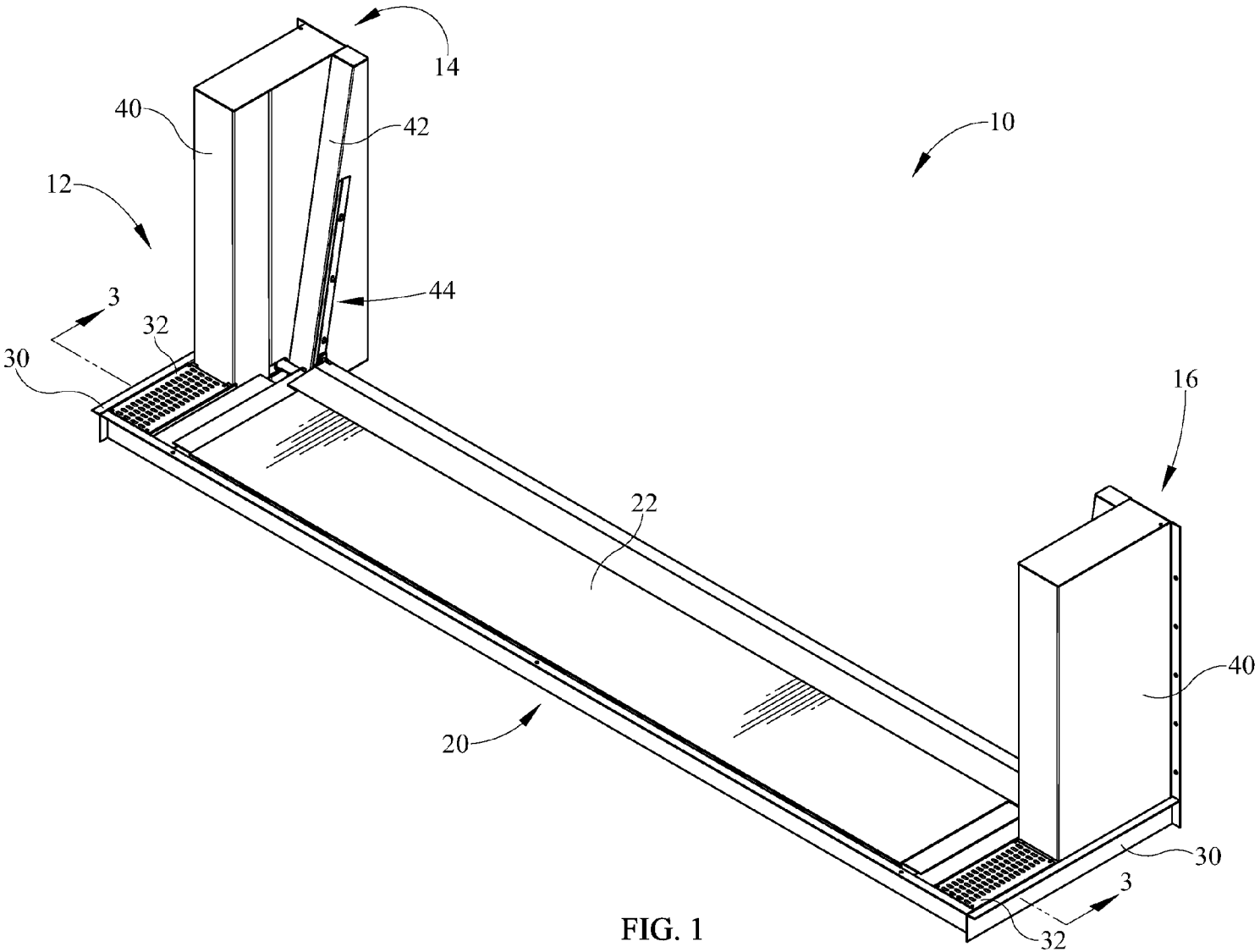
FIG. 1 is an isometric view of an exemplary actuated spill barrier in an unsealed down position.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to the various FIGS. 1-11, an actuated spill barrier having a door is shown which is recessed within a sump during normal usage, but upon actuation will raise to a sealed position to inhibit passage of spilled fluid beyond a preselected location. The actuation of the spill barrier may occur by spilled fluid entering a sump or by heat from a fire, either of which may cause a rising and rotation of the barrier in order to limit leakage of spilled or subsequently spilled fluid. The extreme thermal conditions of a fire do not limit operation by way of seizing or binding parts of the spill barrier.

Referring initially to FIG. 1, an isometric view of the actuated spill barrier 10 is depicted. The spill barrier 10 includes a chassis 12 including a first substantially upright pier 14 and a second substantially upright pier 16. The chassis 12 also includes a sump 20 wherein a door or barrier 22 is normally positioned. The door 22 rotates from its position of FIG. 1 in the sump 20 to sealingly engage the piers 14, 16 when actuated as shown in FIG. 2.

Figure 2:
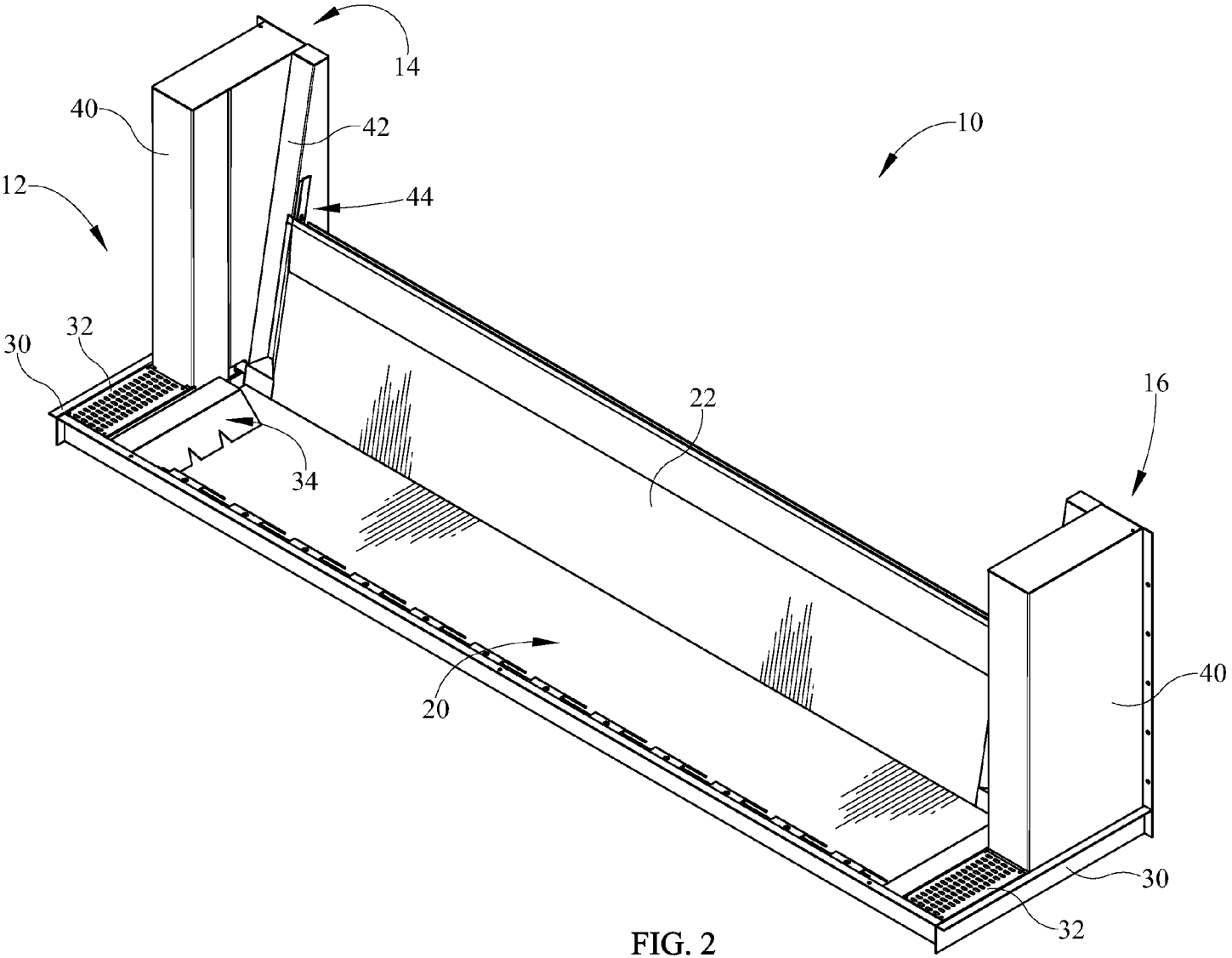
FIG. 2 is an isometric view of the exemplary actuated spill barrier of FIG. 1 in an sealed position.

As shown in FIG. 2, the door 22 is moved to a second upper position in order to sealingly engage the first pier 14 and the second pier 16. The door 22 is actuatable by at least two methods. In one circumstance, the door 22 may be actuated by fluid leaking from a storage area, for example, into the sump 20 where the door 22 is normally positioned. As will be described further, the door 22 may be buoyant, or alternatively counterbalanced by biasing assembly 50, so that the leaked fluid entering the sump 20 causes the door 22 to rise and pivot until the actuation force of a biasing assembly 50 causes the door to move from a partially raised position to the position shown in FIG. 2. For purpose of this description, the term buoyant as used throughout may mean that the door 22 may float alone or with the counterbalance aid of a biasing assembly 50, or a combination thereof though an initial actuation due to fluid in the sump 20. Alternatively stated, the door 22 may be at least partially buoyant with the aid of biasing counterbalance force or forces. Additionally, or alternatively, heat from a fire near the storage area where the spill barrier 10 is located may also cause thermal expansion of the door 22, such that geometry of ends of the door 22 causes the door 22 rises at least slightly from the sump 20. Upon this initial actuation of the door 22 which causes slight or partial raising, the biasing assembly 50 subsequently causes the door 22 to move to the position shown in FIG. 2. The spill barrier 10 includes a two stage bias assembly 50 to move the door to the sealed position of FIG. 2. Thus the system 10 operates with an initial actuation caused by one or both of fluid in the sump 20 (with or without the counterbalancing of the biasing assembly 50) or heat. The initial or primary actuation is followed by a secondary actuation of the biasing assembly 50 which may include one or more stages.

Referring again to FIG. 1, the chassis 12 includes a plurality of structural elements 30 which define bounds of the sump 20. The chassis 12 is positioned in a substrate such as a floor at a doorway to a storage area. At ends of the sump 20 near the first pier 14 and second pier 16 are grate elements 32. The upper elevation of the structural elements 30 and grates 32 are generally positioned at floor level and the grates 32 allow spilled fluid to enter the sump 20. The first and second piers 14, 16 are substantially upright structures and have covers 40 disposed thereabout to provide an aesthetically pleasing appearance as well as hide the internal components of the piers 14, 16 and the underlying structural elements. Disposed along the inside surfaces of the piers 14, 16 is a tapered door engagement surface 42. Positioned along this surface 42 is a sealing member 44 against which the door 22 engages to sealingly engage the piers 14, 16. Each pier 14, 16 has an engagement surface 42 upon which a sealing member 44 is positioned. The distance between the surfaces 42 may be the equal to or greater than the width of door 22 to maintain a seal in the event of thermal expansion of the door 22 in the direction between piers 14, 16. The sealing member 44 engages the door when the door 22 rises from the sump 30.

Referring again to FIG. 2, the door 22 is shown in the sealed position. The door 22 may move from a zero degree horizontal position about 100 degrees to the position depicted, although other ranges of door movement may be utilized. When in the position depicted, the center of gravity is not positioned above the door 22 so that gravity is continually forcing the door 22 toward the closed position. As a result, gravity aids in mainting the door 22 in a sealed position regardless of whether fire or heat damage the biasing assembly 50.

Figure 3:
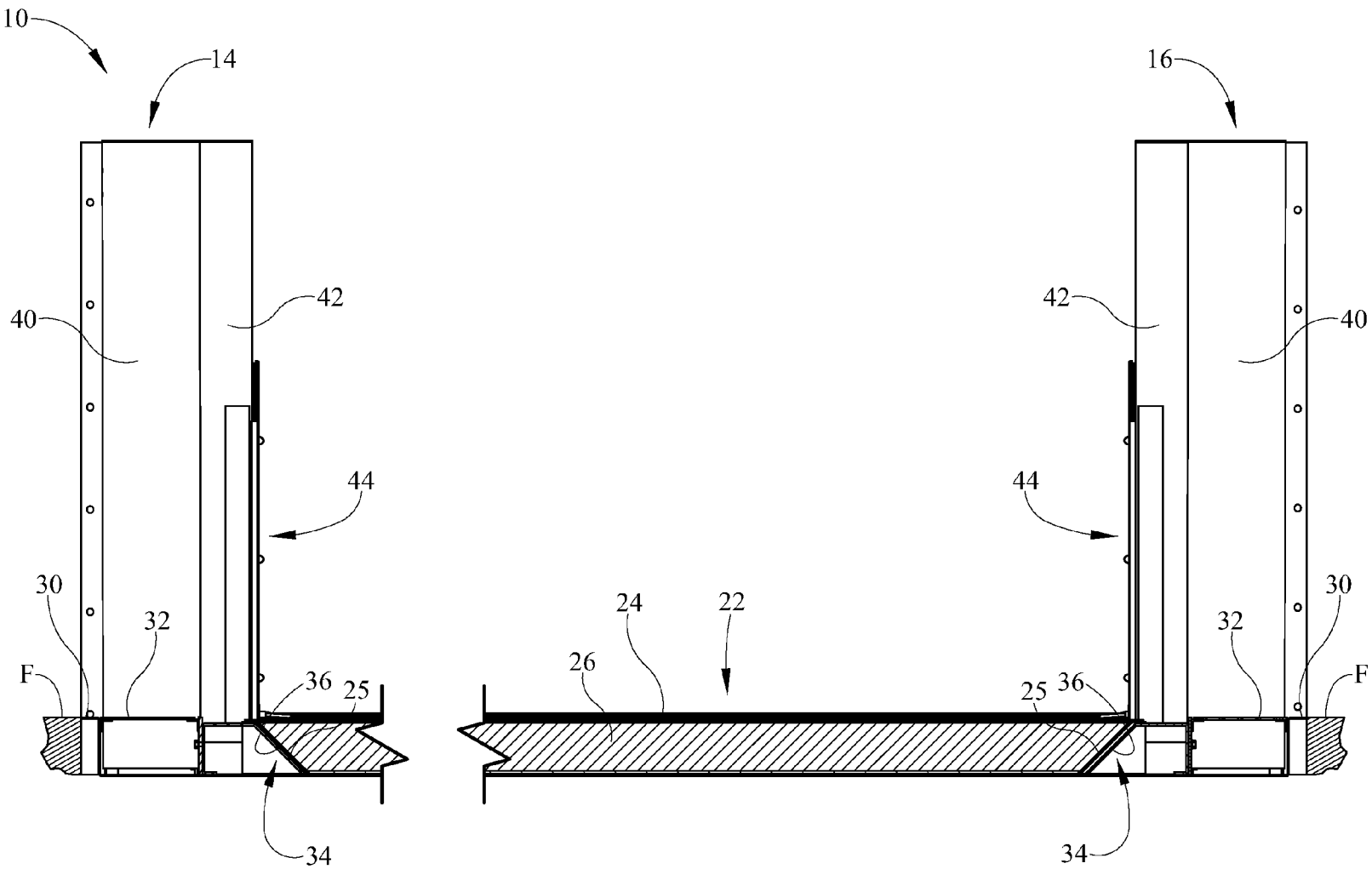
FIG. 3 is a front section view of the spill barrier revealing tapered ends of the spill barrier door.

Referring now to FIG. 3, a front section view is depicted. The grate 32 is positioned on the structural members 30 generally near floor level. The grate 32 allows fluid flow into sump 20 causing flotation of door 22 either alone or in combination with spring biasing.

Figure 4:
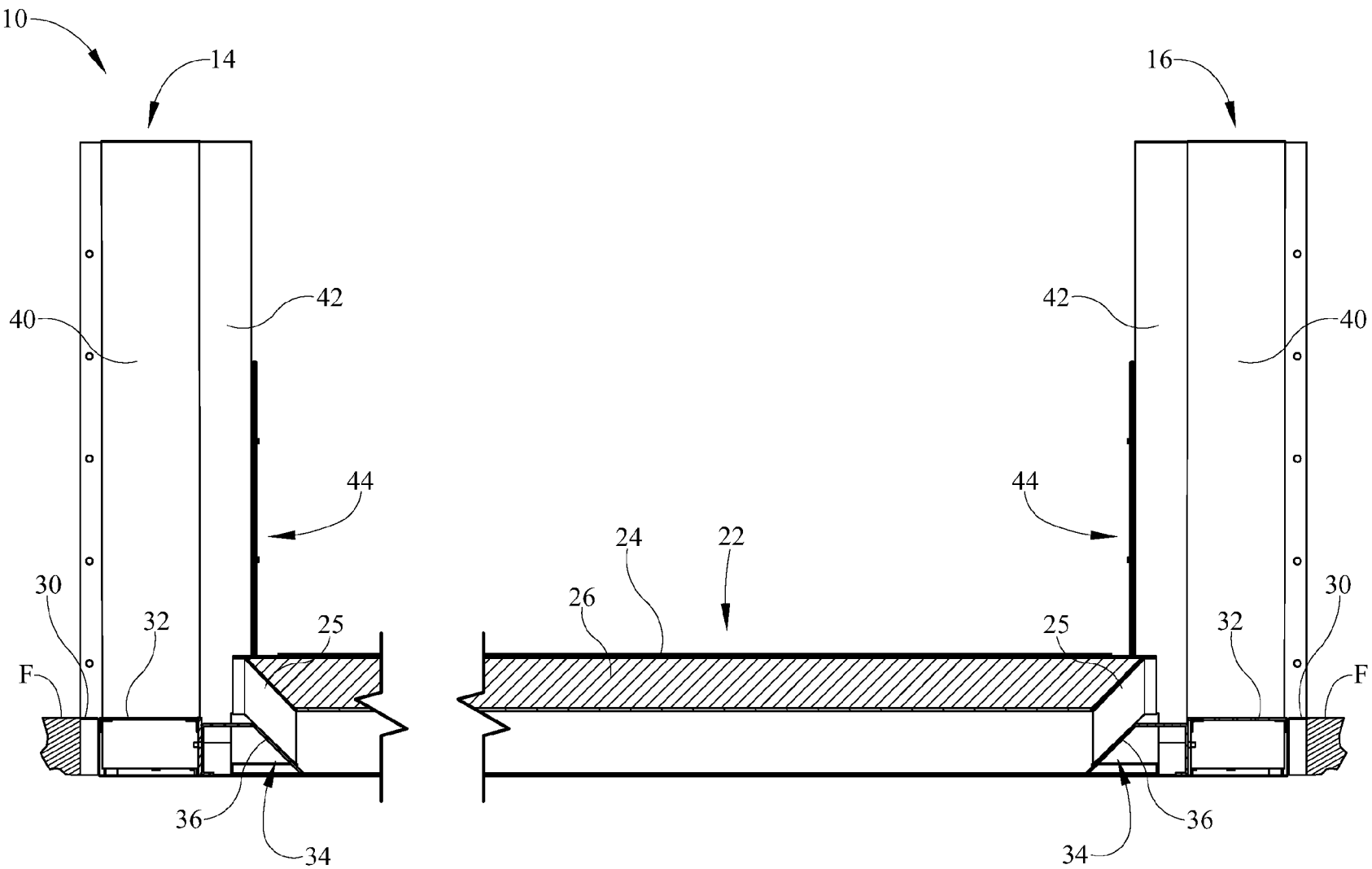
FIG. 4 is a front section view of the spill barrier with the door actuated due to thermal expansion.

Within the sump 20, a wedge 34 is positioned adjacent each end of the door 22. Each wedge 34 has an angled surface 36 adjacent the door 22 which forms a supplementary angle with an end surface of the door 22. The wedges 34, specifically the complementary surfaces 36, cause the door 22 to raise upwardly when the door 22 thermally expands in the horizontal direction during fire conditions, as shown in FIG. 4. As a result of the expansion, the ends of the door 22 rise upwardly and ride along the supplementary surfaces 36 between the piers 14, 16. In short, the supplementary angles of the adjacent surfaces of the door 22 and sump 20 forces the door 22 out of the sump upon thermal expansion without binding the door 22.

Still referring to FIG. 3, the sump area 20 underneath the grate 32 is hollow and allows passage and collection of fluid therein. The fluid which is collected in the sump 20 where the door 22 is disposed, causes the door 22 to rise out of the sump 20, with or without aid of the biasing assembly 50, and begin its actuation process upwardly to the ultimate position which is seated against the sealing surface 42 and the sealing member 44 of the piers 14, 16.

Figure 5:
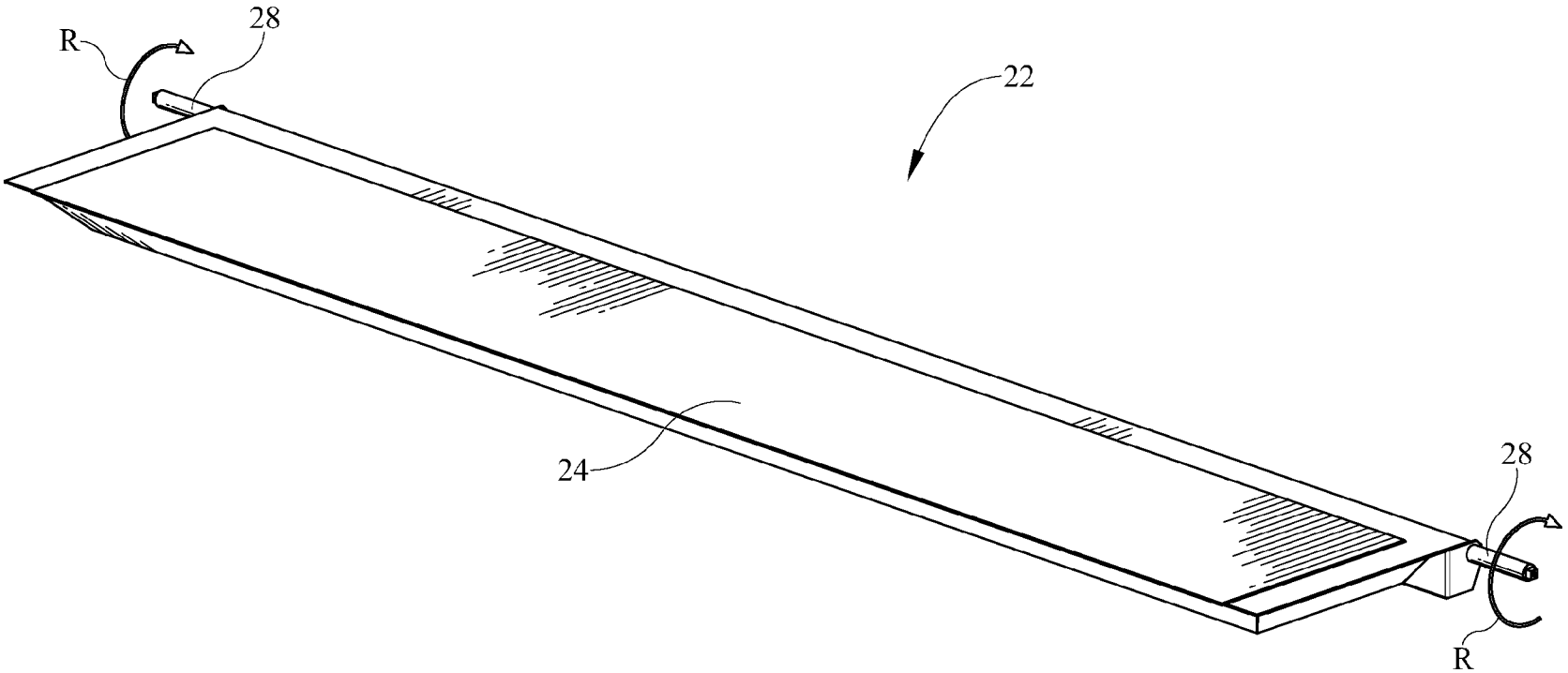
FIG. 5 is an isometric view of the spill barrier door.

Referring now to FIG. 5, an isometric view of the door 22 is depicted. The door 22 pivots about one side by pivot shafts 28. The shafts 28 extend from ends of the door 22 and are pivotally retained within the piers 14, 16. The door 22 includes an upper plate 24 formed of a hardened material in order to allow traffic to pass over the door 22 when the door is in the normal, down position in sump 20. In an alternative embodiment, a single pivoting shaft may extend along the entire length of the door 22 to provide pivoting motion relative to the piers 14, 16, sump 20 and chassis 12. Additionally, as shown in FIG. 6, a kicker plate 27 may be used at the pivoting end of the door 22 to protect any sealing feature along that end of the door 22 from normal traffic passing over the door, such as forklifts or other equipment.

Figure 6:
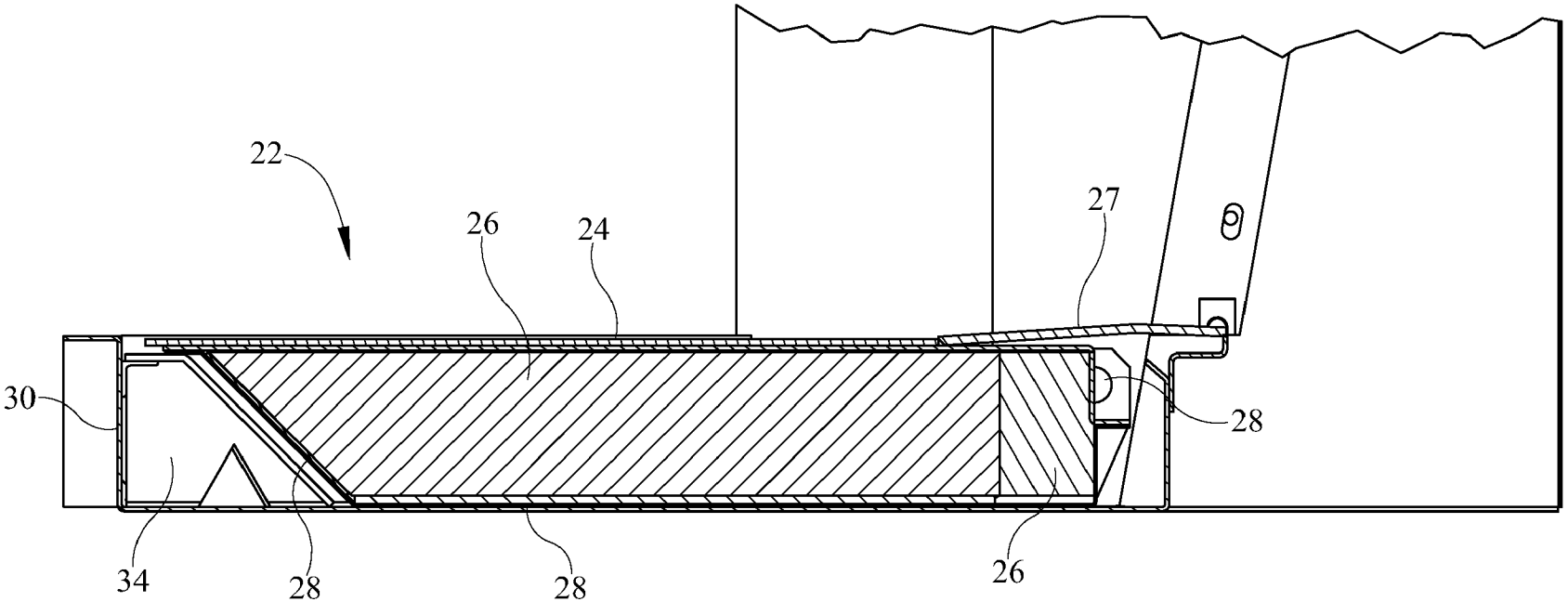
FIG. 6 is a section view of the door of FIG. 4.

Referring now to FIG. 6, a side section view of the door 22 is depicted. As previously described, the door 22 is buoyant so that when the sump 20 fills with a fluid, the door 22 begins rotating from the sump 20 and subsequently the biasing assembly actuates the door to a sealed position against the piers 14, 16. In order to render the door 22 buoyant, the outside portion of the door is formed of resilient lightweight metallic material, while the interior volume comprises wood portions 26 to provide a buoyant structure. The internal wood portions 26 are covered in a steel material which inhibits damage of the woods 26. The wood 26 may be further wrapped or surrounded by a "Pro-Mat" material which insulates the wood 26 of the door 22 from fire and heat. This material is commercially available from Denios. Alternatively, other lightweight materials may be positioned within the door 22.

Figure 7:
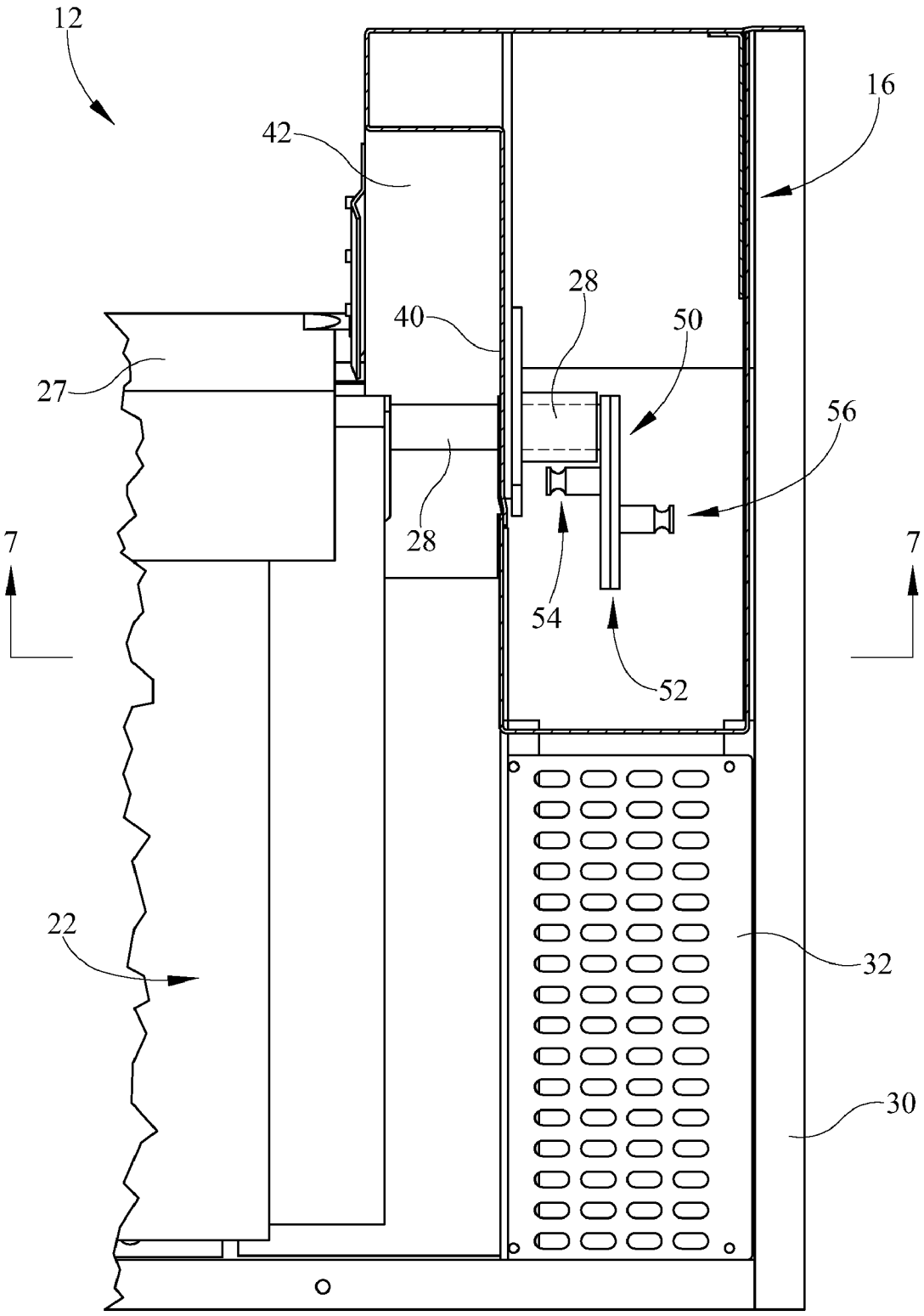
FIG. 7 is a top section view of a pier.

Referring now to FIG. 7, a top section view of the pier 16 is depicted. Adjacent the pier 16 is the grate 32 and the surrounding chassis structure 30. The door 22 is shown positioned in the sump 20 (FIG. 1). Extending from the door 22 is the pivoting shaft or pin 28. The pin 28 extends through the cover 40 of the pier 16 and a biasing assembly 50 is positioned within the pier 16. The biasing assembly 50 includes a lever arm 52 which is operably connected to the door 22 and the shaft 28 and provides rotation in the direction indicated by the rotation arrows R shown in FIG. 5. The biasing assembly 50 includes a lever arm 52 having a first peg 54 extending from one side of the lever arm 52 and a second peg 56 extending from the opposite side of the lever arm 52. The lever arm 52 is connected to first and second biasing elements 53, 55 (FIG. 8) which cause rotation of the lever arm 52 and therefore rotation of the pivot pins 28 and door 22.

Also show in FIG. 7 is the kicker plate 27 which extends between piers 14, 16. The plate 27 protects a lower seal against which the door 22 rotates. Thus, traffic passing over the door 22 does not damage the seal. The kicker plate 27 is pivotally connected to the piers 14, 16 so that as the door 22 rotates during actuation, the door 22 also rotates so not to hinder movement of the door 22.

Figure 8:
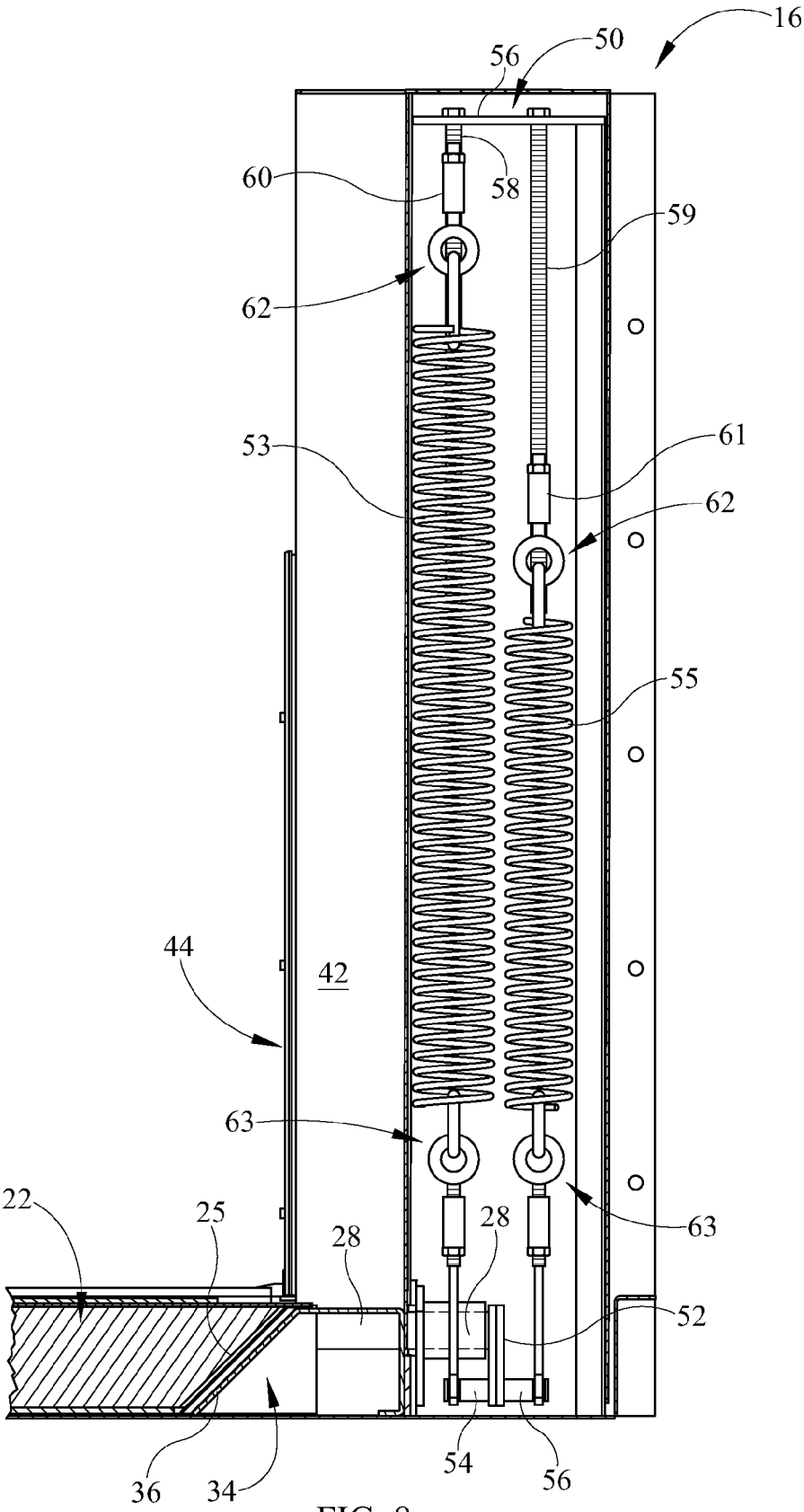
FIG. 8 is a front section view of the pier revealing an exemplary biasing assembly.

Referring now to FIG. 8, a front section view of the chassis 12 and pier 16 is depicted. With the lever arm 52 connected to the pivot pin 28, the door 22 can rotate to an upper position shown in FIG. 2. As previously described, the door 22 may be initially raised and begin its rotation by either fluid entering the sump 20 or by thermal expansion of the door 22 causing the end surfaces 25 of the door 22 to ride upwardly along the wedge surface 36. The angled engagement of surface 25 and surface 36 forces the door 22 out of the sump 20. The angled surfaces also inhibit binding of the door 22 within the sump 20. After the initial rising of the door 22 via heat or sump flooding, the biasing assembly 50 actuates the door to the fully sealed position against surface 42 and sealing element 44. Thus, the heat or thermal expansion causes initial actuation of the door 22 which may or may not be aided by the biasing assembly 50. The initial actuation is followed by a secondary two-stage actuation from within piers 14, 16.

Within the pier 16, the biasing assembly 50 is depicted having a first stage biasing member 53 and a second stage biasing member 55. Across the upper portion of the pier 16 is an upper plate 56 having first and second depending rods 58, 59. Each of the first and second rods 58, 59 are threaded and include an upper head which is drivable with a socket assembly or wrench. Each rod 58, 59 includes a threaded collar 60, 61 which is movable along the corresponding rod 58, 59 by rotation of the rod. Each of the collars 58, 59 is connected to a linkage 62 and the corresponding biasing member 52, 54 so that as the collar 60, 61 moves upward or downward along the rod 58, 59 the collar 60, 61 tensions the corresponding spring 53, 55. Extending from the lower ends of the springs 53, 55 are linkages 63 which are connected either directly or indirectly to the pegs 54, 56, as the pegs 54, 56 are pulled by the tensioned springs 53, 55 of the biasing assembly 50. As this occurs, the door 22 pivots about the pin 28 to engage either or both of the sealing member 44 and surface 42. The tension of the biasing elements 53, 55 may vary depending on the torque required to rotate the door 22 from the position of initial actuation to flotation or fire. The elements 53, 55 should not cause movement from the normally down position when the door 22 is in the sump 20.

Figure 9:
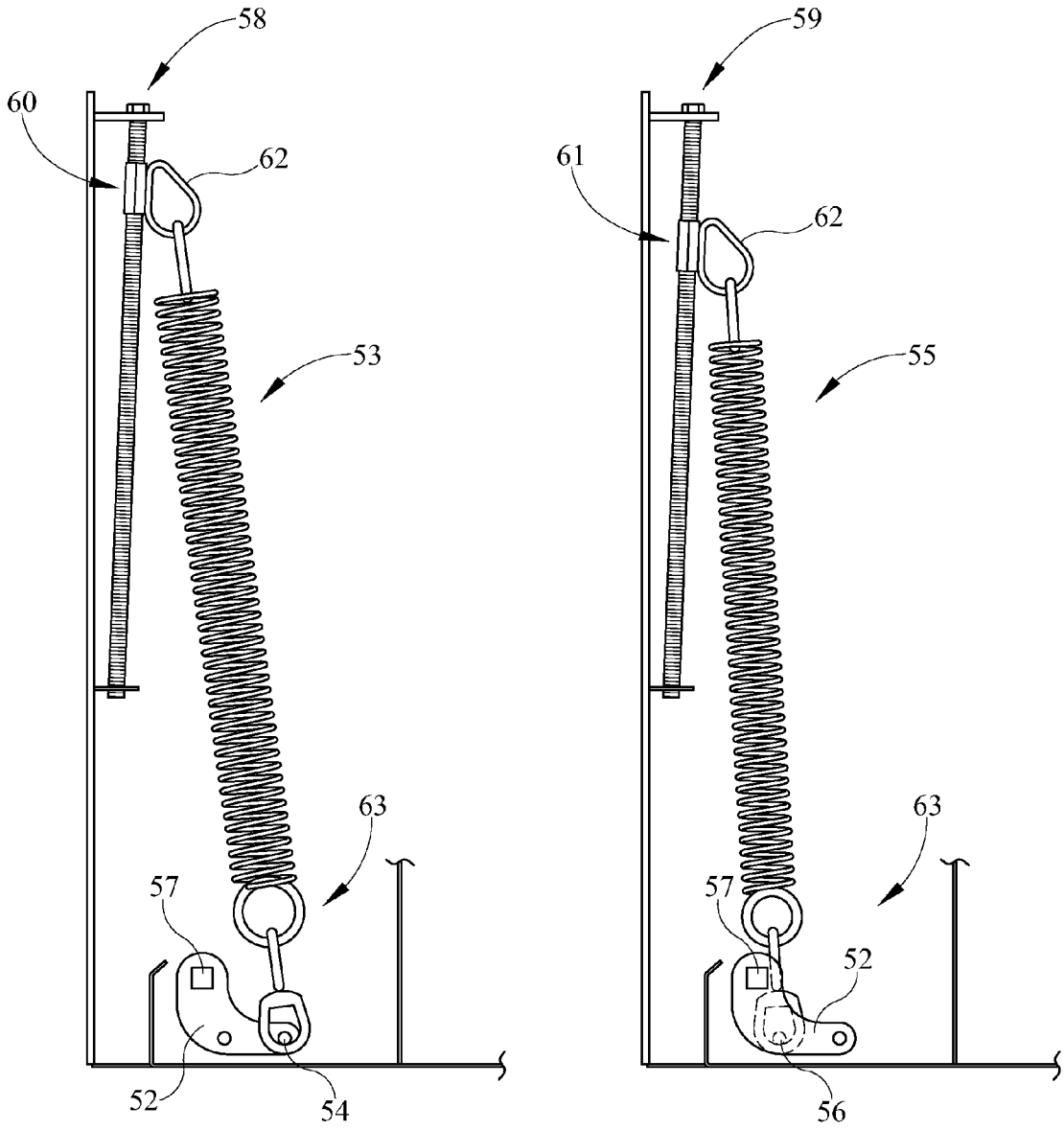
FIG. 9 is an elevation view of each biasing element connected to a lever arm of the biasing assembly.

Referring now to FIG. 9, side views of the biasing assembly are shown. Each side view depicts one of the elements 52, 54 removed for sake of clarity. In the Figure on the left-hand side, the first stage spring 52 is depicted. The first stage spring may ro may not bias the door 22 during the initial actuation when the sump 20 fills with fluid or the door 22 expands due to heat. Additionally, the first stage spring 52 may cause a first portion of door movement during when the secondary actuation begins to move the door 22 to a sealed position. As previously described, the biasing assembly includes a rod 58 having a threaded surface upon which a threaded collar is disposed and moveable in upward and downward direction. The linkage 62 connects the collar 60 to the first stage spring 52. Beneath the spring 52 is a second linkage 62 which connects to the peg 54 on the lever arm 52. The lever arm 52 includes an aperture 57 for receiving the pivoting pin 28 and rotationally connecting the lever arm 52 to the door 22.

The second stage assembly is also shown having a threaded rod 59 which is threadably connected to a threaded collar 61. The collar also includes a linkage 62 for connecting the second stage spring 54 to the collar 61. At the lower end of the spring 54 is the lever arm 52 which is connected by linkage 63. The peg 56 and lower portion of the linkage 63 are shown in broken line, as they are hidden behind the lever arm 52 in the view depicted.

Figure 10:
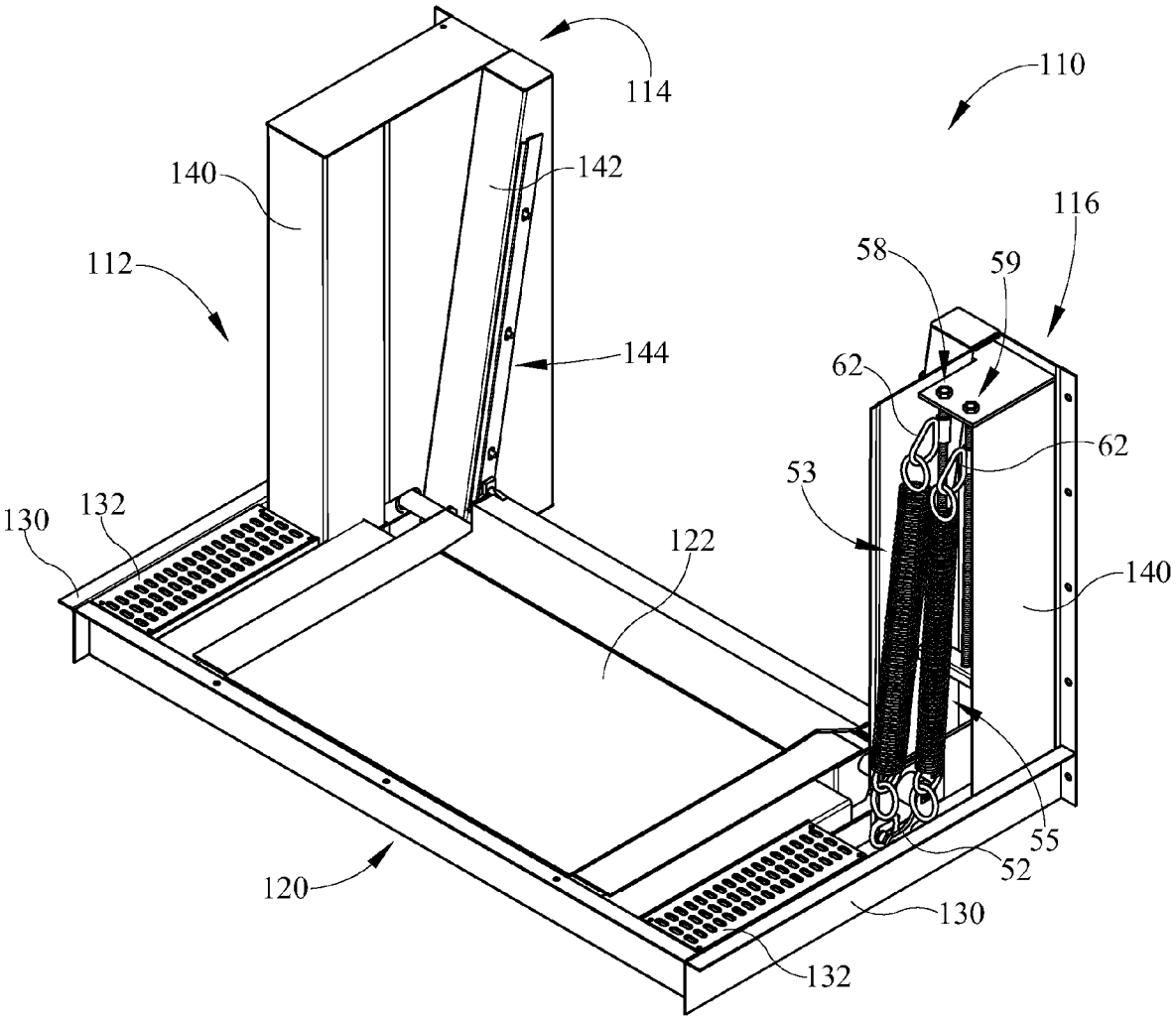
FIG. 10 is an alternate embodiment of an actuated spill barrier in an unsealed position; and, FIG. 11 is an alternate embodiment of FIG. 10 in a sealed position.
Figure 11:
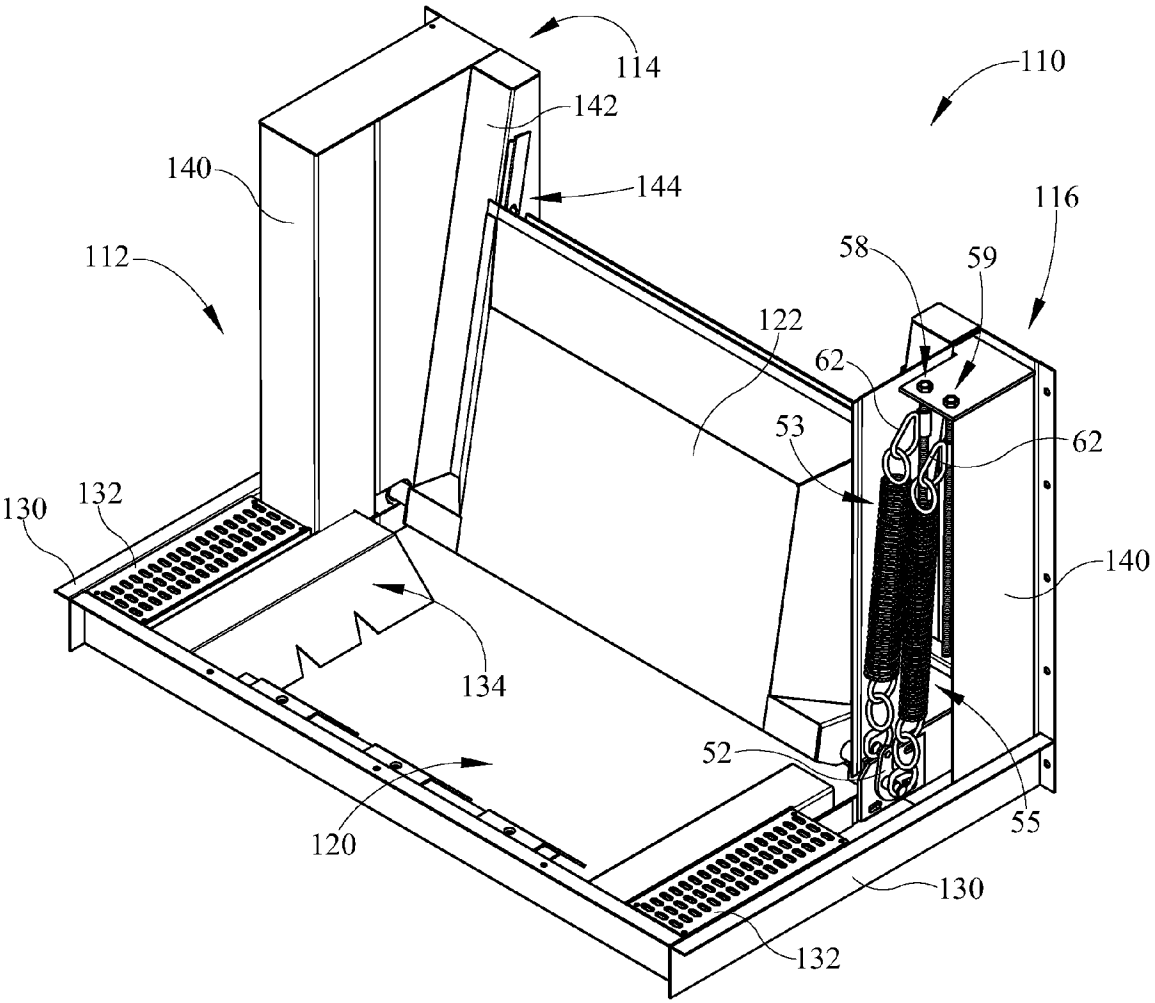

Referring now to FIGS. 10 and 11, an alternative spill barrier 110 is depicted in two views. As shown in FIG. 10, the spill barrier 110 comprises a door 122 which is normally positioned in an unsealed and downward position within a sump 120. As shown in FIG. 11, the door 122 has been initially actuated followed by the two stage actuation of the biasing assembly 150 within the piers 114, 116. In the two views depicted, a portion of the pier covers 140 is removed to depict the biasing assembly 150 shown in the first position wherein the door 122 is down and in a second position wherein the door 122 is up.

In operation, the door 22 positioning a door in a first position within the sump 20 and the door 22 thermally expands forcing the door 22 out of said sump 20 a first distance by the supplementary angles of door end walls 25 and adjacent sump surfaces 36. After this primary actuation, the door 22 has a secondary actuation to a second sealed position with the biasing assembly 50. In this position, the door 20 is in a sealed position inhibiting fluid leakage from escaping the storage area.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An actuated spill barrier, comprising:

a chassis having a first pier and a second pier;

a sump disposed within said chassis, said sump structure having a first angled wall at a first side and a second angled wall at an opposite second side;

a door pivotally connected to said first pier and said second pier, said door having an angled first end surface and an angled second end surface;

said first angled wall and said angled first end surface being supplementary angles and said second angled wall and said angled second end surface being supplementary angles inhibiting binding of said door;

wherein thermal expansion of said door causes said first end surface to climb upwardly along said first angled wall and said second end surface to climb upwardly along said second angled wall inhibiting binding of said door in said sump;

said door being biased to pivot from a first actuated position to a second position sealing against said first pier and said second pier.

2. The actuated spill barrier of claim 1 further comprising at least one seal structure on each of said first and second piers.

3. The actuated spill barrier of claim 1 wherein said door is substantially flush with a surrounding substrate when disposed in a normal horizontal position within said sump.

4. The actuated spill barrier of claim 1, said second position being substantially vertical.

5. The actuated spill battier of claim 1, said second position being about 110 degrees from said first horizontal position.

6. The actuated spill barrier of claim 1 wherein heat causes thermal expansion of said door.

7. The actuated spill barrier of claim 6, said door rising from said sump during said thermal expansion.

8. The actuated spill barrier of claim 7 further comprising at least one spring to bias said door after said door rises during said thermal expansion.

9. The actuated spill barrier of claim 8, said spring being a first stage spring and a second stage spring.

10. The actuated spill barrier of claim 1, said door being at least partially buoyant.

11. The actuated spill barrier of claim 10 wherein said door lifts when said sump fills with a fluid to a first actuated position.

12. The actuated spill barrier of claim 1, said door being biased from an actuated position by at least one biasing element after a primary actuation after said door lifts due to buoyant forces.

13. The actuated spill barrier of claim 12, said at least one biasing element being at least one spring.

14. The actuated spill barrier of claim 13, said at least one spring being a first spring and a second spring in each of said first and second piers.

15. An actuated spill barrier, comprising:

a chassis having a sump therein and a first pier and a second pier;

a door pivotally connected to at least one of said chassis, said first pier or said second pier;

said door having a first end and a second end, said first end and said second end being tapered at an angle supplementary to adjacent surfaces of said sump so that thermal expansion of said door causes said door to raise from said sump without binding;

said door movable from a first position horizontally disposed within said sump to a second position sealingly engaging said first pier and said second pier;

a biasing assembly disposed within said each of said first pier and said second pier, said biasing assembly operably connected to said door;

said biasing assembly lifting said door to sealing engagement with said first and second piers after said door is at least partially raised from said sump.

16. The actuated spill barrier of claim 15, said door being buoyant so as to raise when fluid levels exceed a preselected amount in said sump.

17. The actuated spill barrier of claim 15, said biasing assembly including a lever arm, said lever arm being operably connected to said door.

18. The actuated spill barrier of claim 17 further comprising at least one spring.

19. The actuated spill barrier of claim 18 further comprising a first spring and a second spring in each of said first pier and said second pier, said one of said first spring and said second spring lifting said door a first distance and the other of said first spring and said second spring lifting said door a second distance.

20. The actuated spill barrier of claim 15, said door rotating from a substantially horizontal position in said sump to a position slightly beyond vertical.

21. An actuated spill barrier, comprising:

a chassis including a sump and opposed first and second piers;

a door pivotally connected to said chassis and movable from a first substantially horizontal position to a second position substantially sealingly engaging said first and second piers;

said door having a first end and a second end, each of said first and second ends being tapered and supplementary to corresponding—first and second—sides of said sump;

wherein thermal expansion of said door causes the first end to climb upwardly along the first side and the second end to climb upwardly along the second side inhibiting binding of said door in said sump;

said door being movable to a first actuated position by a primary actuation and said door being movable to said second position by a secondary actuation of a biasing assembly.

22. A method of actuating a spill barrier, comprising:

positioning a door in a first position within a sump;

thermally expanding said door;

forcing said door out of said sump a first distance by supplementary angles of door end walls and adjacent sump surfaces; and, actuating said door to a second sealed position with a biasing assembly.

* * * * *